US006945418B2

(12) United States Patent
Guido et al.

(10) Patent No.: US 6,945,418 B2
(45) Date of Patent: Sep. 20, 2005

(54) RACK MOUNTABLE BEVERAGE BOTTLE

(75) Inventors: John Anthony Guido, Arroyo Grande, CA (US); Craig Dale Machado, Arroyo Grande, CA (US)

(73) Assignee: Joseph Amaral, San Luis Obispo, CA (US)

( * ) Notice: Subject to any disclaimer, the term of this patent is extended or adjusted under 35 U.S.C. 154(b) by 38 days.

(21) Appl. No.: 10/238,382

(22) Filed: Sep. 9, 2002

(65) Prior Publication Data

US 2003/0071008 A1 Apr. 17, 2003

Related U.S. Application Data

(60) Provisional application No. 60/322,269, filed on Sep. 10, 2001.

(51) Int. Cl.[7] ..... B65D 1/02; B65D 23/00

(52) U.S. Cl. ..... 215/377; 215/372; 220/630

(58) Field of Search ..... 215/372, 374, 215/377, 378, 383; 220/630; 211/74

(56) References Cited

U.S. PATENT DOCUMENTS

| | | | | | |
|---|---|---|---|---|---|
| 88,105 | A | * | 3/1869 | Whitney | 215/10 |
| 1,106,030 | A | * | 8/1914 | Devarney | 215/365 |
| 1,419,509 | A | | 6/1922 | Newell | |
| 1,514,375 | A | | 11/1924 | Crimmel | |
| D71,066 | S | * | 9/1926 | Jones | D9/500 |
| 1,744,947 | A | | 1/1930 | Bowman | |
| 2,086,404 | A | * | 7/1937 | Daniels | 215/377 |
| 2,169,869 | A | * | 8/1939 | Blunt | 215/383 |
| 2,301,710 | A | | 11/1942 | Scudder | |
| D156,002 | S | | 11/1949 | Heftler-Louiche | |
| 2,905,351 | A | * | 9/1959 | Lerner | 215/376 |
| D203,074 | S | | 11/1965 | Adell | |
| 3,438,116 | A | | 4/1969 | Stengle | |
| 3,482,731 | A | * | 12/1969 | Douty | 220/630 |
| 3,526,335 | A | * | 9/1970 | Swett et al. | 220/630 |
| D228,172 | S | | 8/1973 | Byrne | |
| D229,746 | S | | 1/1974 | McPhee | |
| D233,217 | S | | 10/1974 | Blocksom | |
| D234,998 | S | | 4/1975 | Achenbach | |
| D243,442 | S | | 2/1977 | Montgomery | |
| 4,178,976 | A | * | 12/1979 | Weiler et al. | 604/415 |
| 5,080,149 | A | * | 1/1992 | Peoples | 141/337 |
| 5,332,112 | A | | 7/1994 | Blocker | |
| D366,214 | S | | 1/1996 | Cooper | |
| 5,624,043 | A | | 4/1997 | Baptista | |
| 5,638,982 | A | * | 6/1997 | Spector | 220/630 |
| D380,352 | S | * | 7/1997 | Meiji | D7/629 |
| D387,624 | S | * | 12/1997 | Meiji | D7/629 |
| 5,751,660 | A | | 5/1998 | Chappell | |
| 5,829,607 | A | * | 11/1998 | Ibrahim | 215/44 |
| D401,817 | S | | 12/1998 | Doret, Jr. et al. | |
| 6,003,693 | A | | 12/1999 | Blickenstaff | |
| 6,220,458 | B1 | | 4/2001 | Falor | |
| 6,234,326 | B1 | * | 5/2001 | Higgins et al. | 211/74 |
| D470,770 | S | | 2/2003 | Machado et al. | |
| 2002/0104819 | A1 | * | 8/2002 | Matsui | |

FOREIGN PATENT DOCUMENTS

| | | | | |
|---|---|---|---|---|
| FR | 2641960 A | * | 7/1990 | A47G/19/22 |
| GB | 2324077 A | * | 10/1998 | B65D/23/12 |

* cited by examiner

*Primary Examiner*—Sue A. Weaver
(74) *Attorney, Agent, or Firm*—Philip A Steiner

(57) ABSTRACT

This invention discloses a storage vessel, namely a wine bottle having a liquid volumetric capacity of from about 750 milliliters to about 1,500 milliliters and including an integral pedestal base configured to fit typical glassware fixtures employed in restaurants and taverns. The stem and base portions of the pedestal may be solid or hollow. A hollow pedestal may be advantageous to capture sediments settling out of the wine when the bottle is in an upright position. Pigments may be included in the glass construction to minimize photochemical reactions with the wine contained within the bottle.

10 Claims, 4 Drawing Sheets

RACK MOUNTABLE BEVERAGE BOTTLE

CROSS-REFERENCE TO RELATED APPLICATIONS

This patent application claims priority from provisional application Ser. No. 60/322,269 filed on Sep. 10, 2001 entitled "Rack Mountable Beverage Bottle," and is herein incorporated by reference.

FEDERALLY SPONSORED RESEARCH AND DEVELOPMENT

Not Applicable.

REFERENCE TO A MICROFICHE APPENDIX

Not Applicable.

FIELD OF INVENTION

The present invention relates generally to a rack mountable storage vessel namely a beverage bottle with an integral pedestal base that allows the bottle to be slidably rack-mounted.

BACKGROUND OF INVENTION

The prior art related to wine bottles is extensive and dates back in antiquity to amphora type containers, clay pitchers, goatskins, etc. all having as primary functionalities storing and transporting of the beverage. Modernly, wine bottles serve additional functions by adding aesthetics and ambience to a commercial establishment such as a restaurant or bar. For example, it is known in the art that Italian restaurants frequently use empty Chianti wine bottles as candlestick holders, which are placed on customer tables. The Chianti bottles add a romantic and cultural ambience to the restaurant thus improving the dining experience of their customers. In another example, Japanese cuisine, in particular sushi has become popular developing a demand for authentically styled sushi bars complete with bottles of rice wine known as sake. The sake bottles are generally placed in the field of view of patrons seated at a sushi bar and feature Japanese labels, which generally include artistic Chinese characters associated with Asian cultures.

From the restaurateur's perspective, wine sales are high profit margin items, thus the strategic placement of attractive wine bottles plays a significant factor in the overall profitability of his or her establishment. By placing the wine bottles in view of the customers, demand for these products is significantly increased. However, in many situations, space is limited for exhibiting the beverages particularly bar and grill type establishments which limits demand to those items that are easily viewed by the establishment's patrons.

SUMMARY OF INVENTION

This invention provides a solution to the limited storage and display space for wines in a retail establishment by integrating a pedestal base into the design of a wine bottle. The pedestal base is configured such that the wine bottles may be placed in overhead racks normally used for supporting glassware. In a bar type setting, the wine bottles are visible to patrons sitting in and around the bar area thus generating demand for the beverage contained therein.

It is envisioned that other supporting structures may allow beverage bottles incorporating the invention to articulate from a substantially horizontal position through a fully inverted position. It is further envisioned that the bottles may contain beverages other than wine. In the preferred embodiment of the invention, the wine bottles are constructed of glass and are sized to contain liquid volumes ranging from about three quarters of a liter to about one and one half liters. Other volumes are also envisioned for magnum, champagne and limited edition sized bottles. Tinting of the glass in various shades to protect the contents of the bottles from photochemical reactions is also envisioned.

DETAILED DESCRIPTION OF PREFERRED EMBODIMENT

The preferred embodiment of this invention is a standard sized beverage bottle having a liquid volumetric capacity of about 750 milliliters and including an integral pedestal base configured to fit typical glassware racks employed in restaurants and taverns. The stem and base portions of the pedestal may be solid or hollow. A hollow pedestal may be advantageous to capture sediments settling out of the wine when the bottle is in an upright position. Pigments may be included in the glass construction to minimize photochemical reactions with the wine contained within the bottle.

Figure 1:
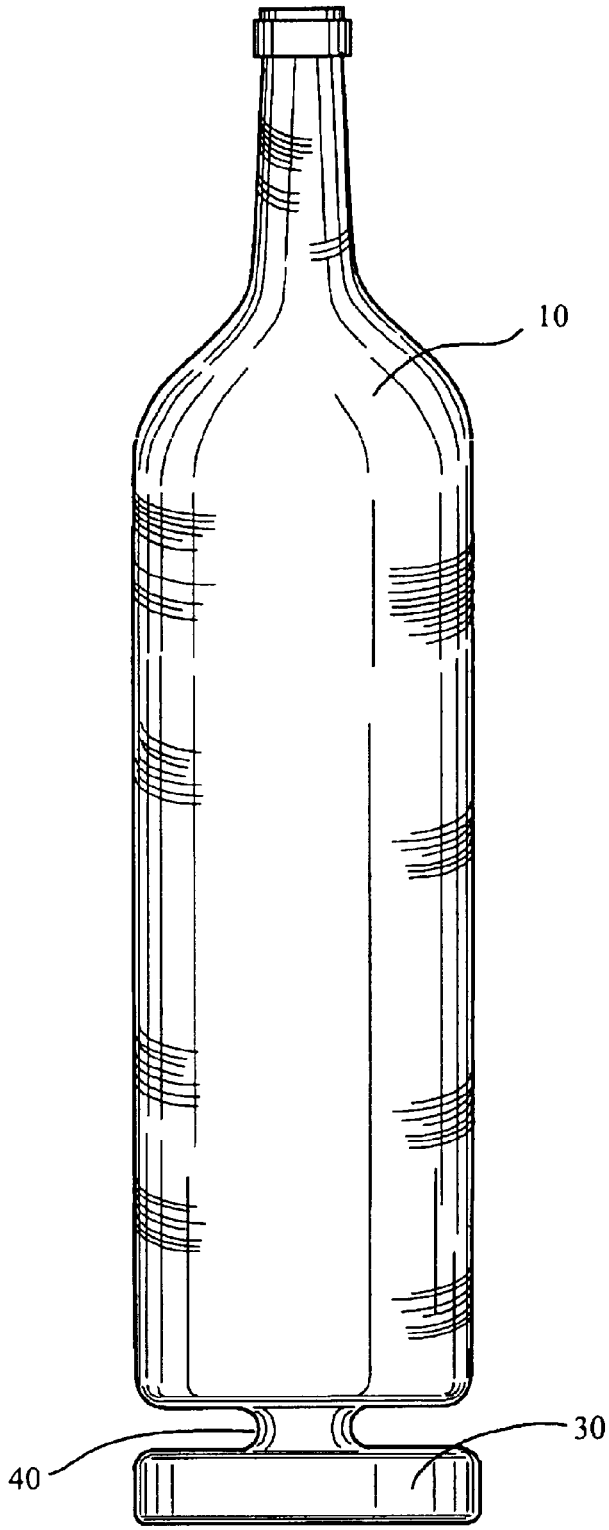
FIG. 1—This drawing depicts a frontal view of the invention including a pedestal base member and a stem.

Referring to FIG. 1, the invention is shown in a frontal view. The bottle 10 comprises a disjunct pedestal base member 30 and stem member 40 which are integral in construction with the bottle 10. The base member 30 is shown as a flat disk configuration having a substantially circular appearance. Other embodiments including a tapered or concave surface are also envisioned. The diameter of the base member approximates the diameter of the bottle. The stem portion of the pedestal should be sized to ensure structural integrity. In the preferred embodiment, the diameter of the stem member 40 is about 30 to 70 percent of the diameter of the bottle and is substantially cylindrical in configuration. The length of the stem member 40 forms the gap between a bottom of the bottle 10 and the top of the base member 30 is sized to provide a loose fit in both the horizontal and vertical planes when slidably installed on a supporting rack. One end of the stem member connects to the bottom of the bottle while an opposite end connects to the top of pedestal base member, such that the beverage bottle, stem member and the pedestal base member are centered along an approximate vertical centerline extending through the beverage bottle, stem member and the pedestal base member.

Figure 2:
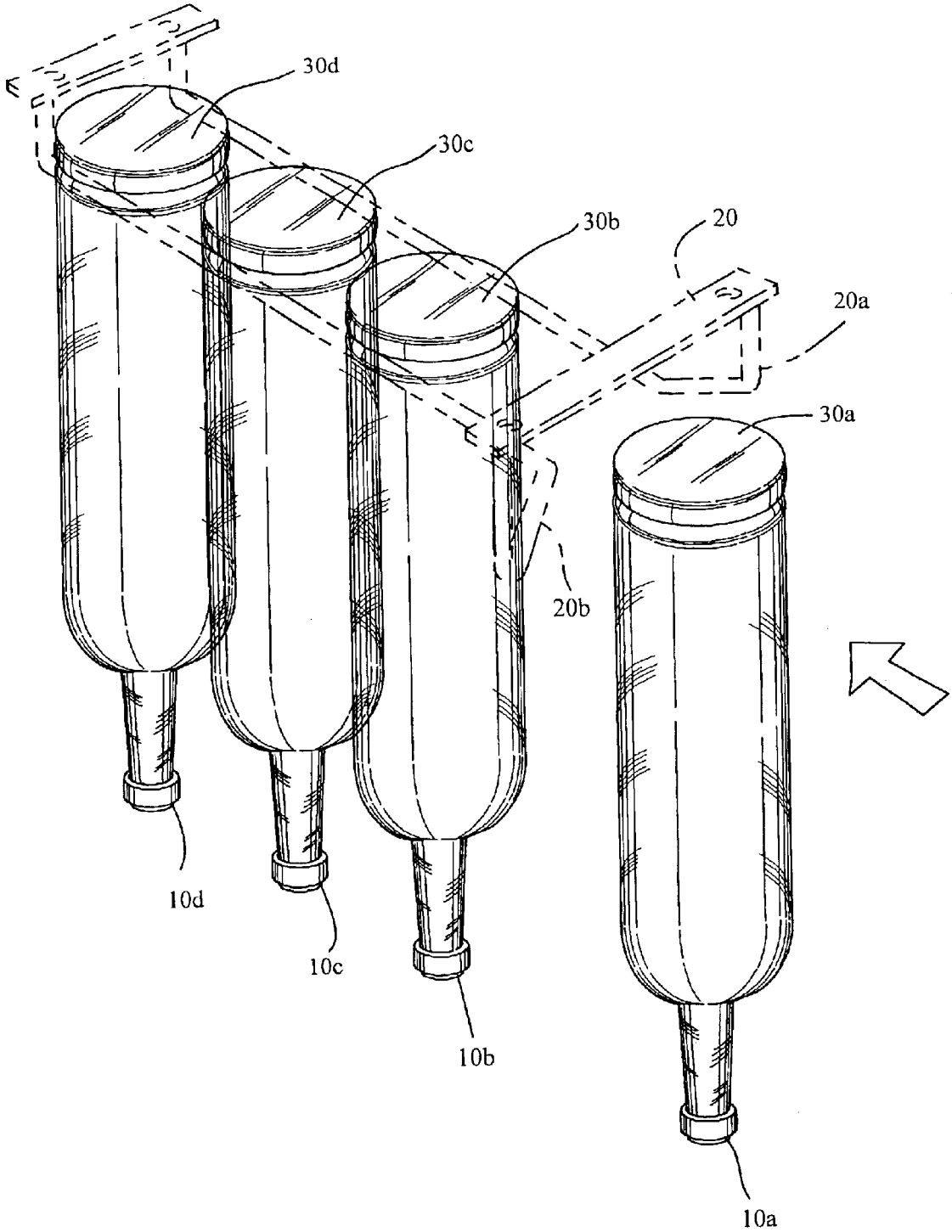
FIG. 2—This drawing depicts a prospective view of the invention where a plurality of wine bottles may be slidably stored in an inverted position on a rack.

Referring to FIG. 2, the invention is shown in a perspective view where pluralities of beverage bottles are supported by a typical glassware rack. The bottles 10A, 10B, 10C, 10D incorporating this invention are slidably installed and supported by the rack 20 and associated side support rails 20A, 20B. The tops of the pedestals 30A, 30B, 30C, 30D supports the weight of the bottle 10A, 10B, 10C, 10D and rests on top of the rack side support rails 20A, 20B. The gap between the bottle 10A, 10B, 10C, 10D and the pedestal includes a stem 40, which provides continuity between the bottle 10A, 10B, 10C, 10D and the base of the pedestal 30A, 30B, 30C, 30D.

Figure 3:
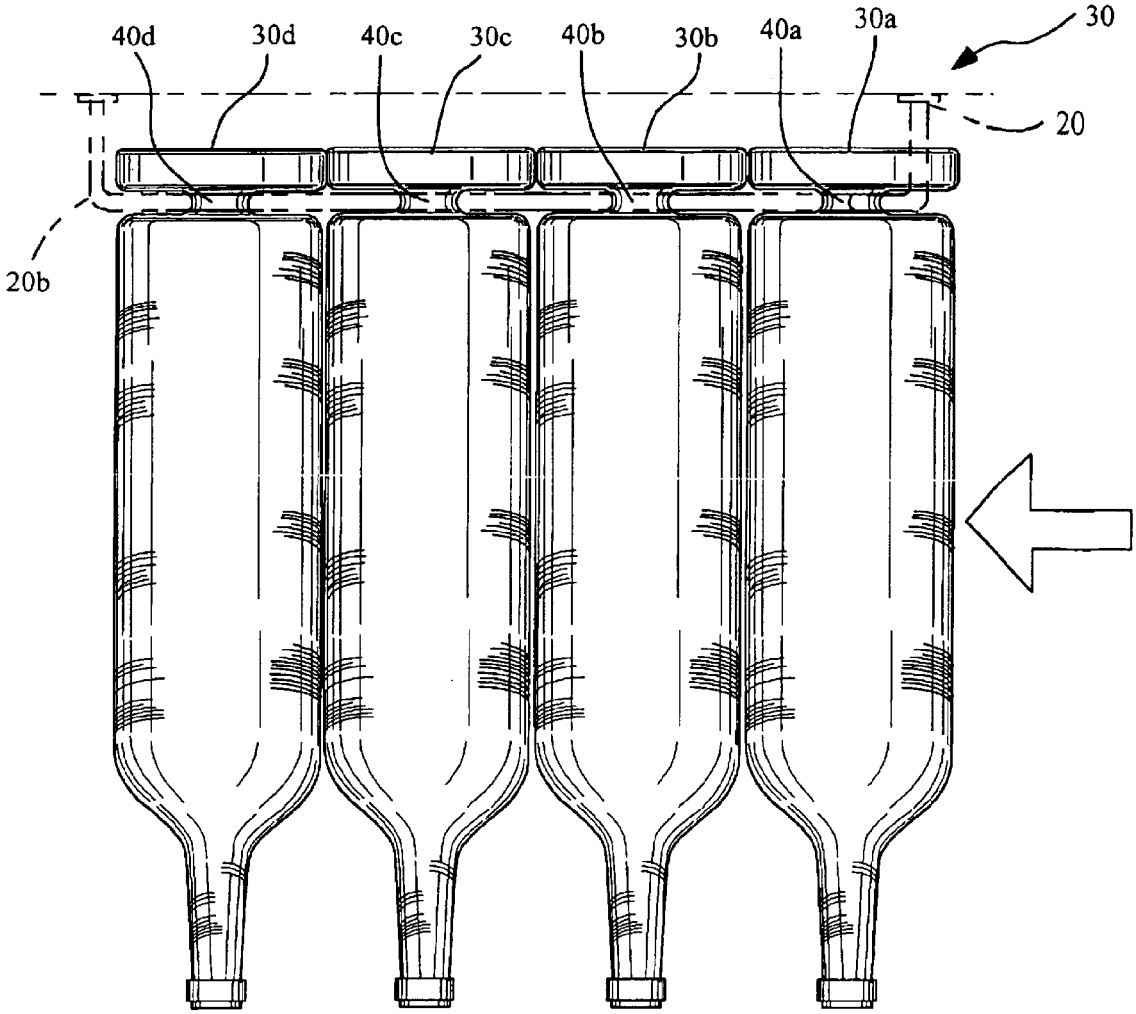
FIG. 3—This drawing depicts a side view of the invention where a plurality of wine bottles may be slidably stored in an inverted position on a rack.

Referring to FIG. 3, the invention is shown in a side view where a plurality of beverage bottles 10A, 10B, 10C, 10D are slidably stored in an inverted position on a rack 20. The bases 30A, 30B, 30C, 30D of the pedestals support the bottles 10A, 10B, 10C, 10D that rests on the rack support rails 20B. The stem portions of the pedestals 40A, 40B, 40C, 40D provides continuity between the actual bottles 10A, 10B, 10C, 10D and the bases of the pedestals 30A, 30B, 30C, 30D.

Figure 4:
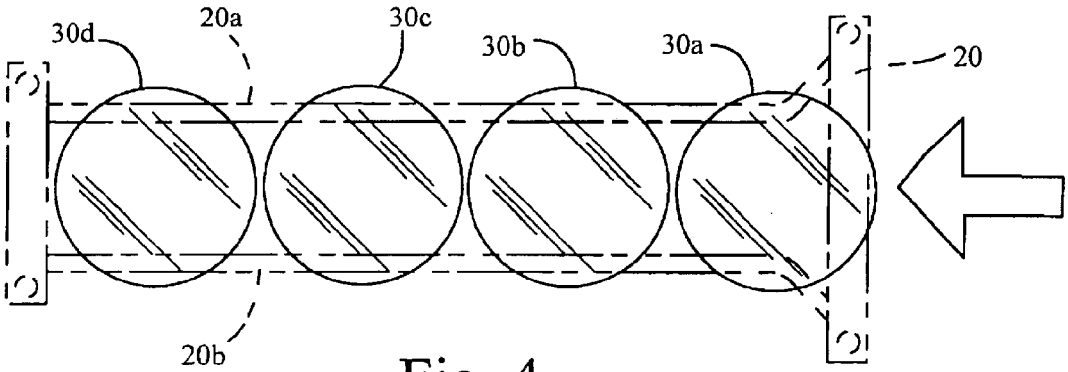
FIG. 4—This drawing depicts a top view of the invention where a plurality of wine bottles may be stored in an inverted position on a rack.

Referring to FIG. 4, the invention is shown in a top view where a plurality of wine bottles 10A, 10B, 10C, 10D are stored in an inverted position on the fixture 20. The bases of the pedestals 30A, 30B, 30C, 30D are shown supported by the fixture's side support rails 20A, 20B.

Figure 5:
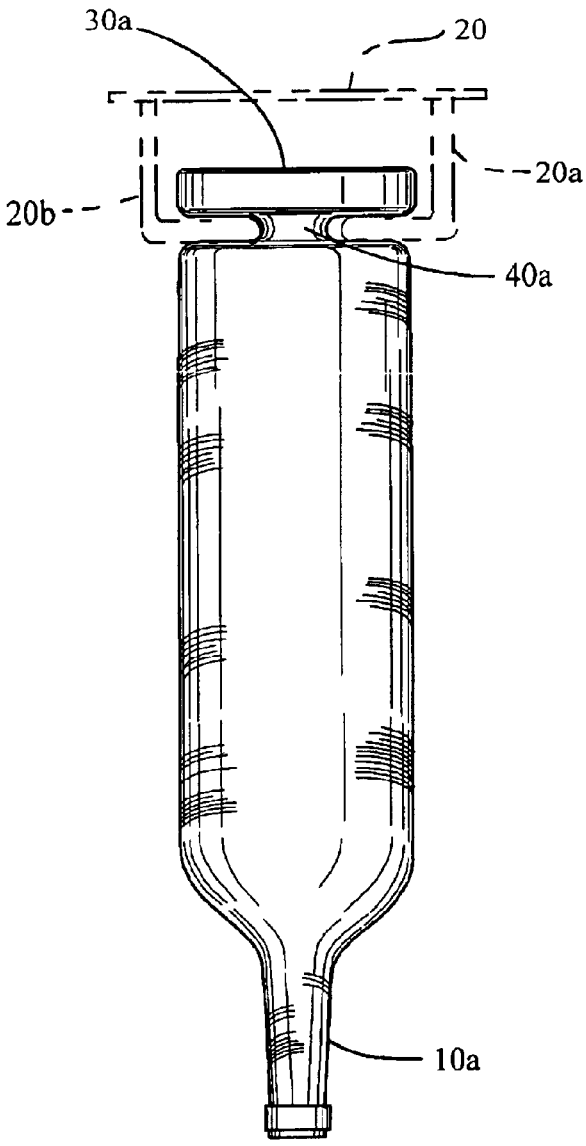
FIG. 5—This drawing depicts a front view of the invention where a wine bottle may be stored in an inverted position on a rack.

Referring to FIG. 5, the invention is shown in a frontal view where the wine bottle 10A is stored in an inverted position on the fixture 20. The base 30A of the pedestal is supported longitudinally on two sides by the fixture support rails 20A, 20B. The stem 40A of the pedestal is substantially centered between the fixture support rails 20A, 20B.

Figure 6:
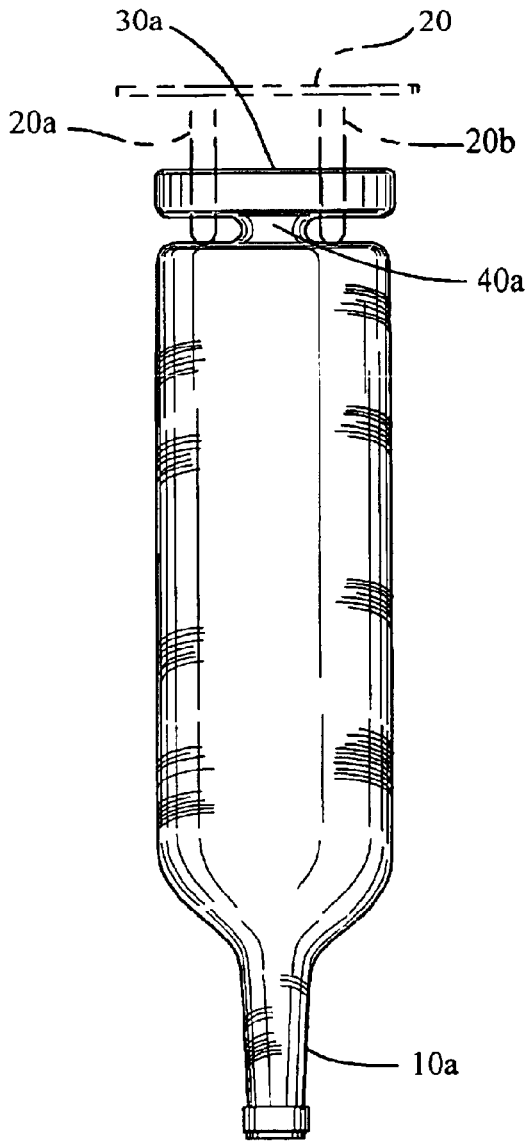
FIG. 6—This drawing depicts a rear view of the invention where a wine bottle may be stored in an inverted position on a rack.

Referring to FIG. 6, the invention is shown in a rear view of the invention where a wine bottle 10A is stored in an inverted position on the rack 20. As previously described above, the base 30A of the pedestal is supported longitudinally on two sides by the rack support rails 20A, 20B. The stem 40A of the pedestal is substantially centered between the rack support rails 20A, 20B. The bottle 10A is prevented from sliding of the end of the rack 20 by the stops incorporated into the rack support rails 20A, 20B.

The foregoing described embodiments of the invention are provided as illustrations and descriptions. They are not intended to limit the invention to the precise form described. In particular, it is contemplated that functional implementation of the invention described herein may be implemented equivalently in glass or plastic having varying pigmentation for tinting and manufactured in various sizes. Other variations and embodiments are possible in light of above teachings, and it is not intended that this Detailed Description limit the scope of invention.

REFERENCES

1. U.S. Pat. No. 6,220,458
2. U.S. Pat. No. 6,003,693
3. U.S. Pat. No. 5,624,043
4. U.S. Pat. No. D401,817
5. U.S. Pat. No. 1,514,375
6. U.S. Pat. No. 5,751,660
7. U.S. Pat. No. 1,419,509
8. U.S. Pat. No. D229,746
9. U.S. Pat. No. D336,214
10. U.S. Pat. No. 1,744,947
11. U.S. Pat. No. 5,332,112
12. U.S. Pat. No. D228,172
13. U.S. Pat. No. 3,438,116
14. U.S. Pat. No. D243,442
15. U.S. Pat. No. 2,301,710
16. U.S. Pat. No. D234,998
17. U.S. Pat. No. D233,217
18. U.S. Pat. No. D156,002
19. U.S. Pat. No. D203,074

We claim:

1. A rack mountable beverage bottle for maintaining and displaying beverages comprising:

the beverage bottle having integrally coupled thereto;

a neck member for receiving a closure member;

a disjunct pedestal base member; and a cylindrical stem member coupled to a bottom of the beverage bottle and at least a top of said pedestal base member, such that said cylindrical stem member provides continuity between said base member and the beverage bottle;

wherein at least a portion of said cylindrical stem member and at least a portion of said top of sad pedestal base member are dimensioned to support the beverage bottle when disposed on a rack.

2. The rack mountable beverage bottle according to claim 1, wherein the beverage bottle is a wine bottle.

3. The rack mountable beverage bottle according to claim 1, wherein the beverage bottle is comprised of a material selected from the group consisting of transparent glass, tinted glass, and plastic.

4. The rack mountable beverage bottle according to claim 1, wherein said pedestal base member has a diameter approximating that of the beverage bottle.

5. The rack mountable beverage bottle according to claim 1, wherein said cylindrical stem member has an approximate diameter of 30 to 70 percent of that of the beverage bottle.

6. The rack mountable beverage bottle according to claim 1, wherein said stem member includes an internal volume contiguous with an interior storage volume of the beverage bottle for trapping sediment.

7. The rack mountable beverage bottle according to claim 1, wherein said support of the beverage bottle includes in an inverted position.

8. The rack mountable beverage bottle according to claim 1, wherein the beverage bottle, said cylindrical stem member and said base member are centered along an approximate vertical centerline extending through the beverage bottle, said cylindrical stem member and said pedestal base member.

9. A rack mountable beverage bottle for maintaining and displaying beverages comprising:

the beverage bottle having integrally coupled thereto;

a neck member for receiving a closure member;

a pedestal base member having;

a diameter approximating that of the beverage bottle, a top for at least supporting the beverage bottle in an inverted position, a bottom for supporting the beverage bottle in an upright position; and a cylindrical stem member having;

a first end coupled to a bottom of the beverage bottle, and a second end coupled to said top of said pedestal base member, wherein at least a portion of said cylindrical stem member and at least a portion of said top of said pedestal base member are dimensioned to support said beverage bottle in either said inverted or upright positions.

10. A rack mountable beverage bottle for maintaining and displaying beverages comprising:

the beverage bottle, wherein the beverage bottle is a wine bottle, a disjunct pedestal base member having;

a diameter approximating that of the beverage bottle, a top for supporting the beverage bottle in an inverted position, a bottom for supporting the beverage bottle in an upright position; and a cylindrical stem member having;

a first end coupled to a bottom of the beverage bottle, a second end coupled to said top of said pedestal base member, and an approximate diameter of 30 to 70 percent of that of the beverage bottle;

wherein at least a portion of said cylindrical stem member and at least said top of said base member are sized to provide a loose fit when slidably mounted on said rack.

* * * * *